US006374736B1

(12) United States Patent
Cresgy et al.

(10) Patent No.: US 6,374,736 B1
(45) Date of Patent: Apr. 23, 2002

(54) SCREEN PRINTING FRAME SCRAPER

(75) Inventors: Joseph D. Cresgy, Terre Haute; Edward Lee Proffitt, Brazil, both of IN (US)

(73) Assignees: Sony Corporation, Tokyo (JP); Digital Audio Disc Corporation, Terre Haute, IN (US)

( * ) Notice: Subject to any disclaimer, the term of this patent is extended or adjusted under 35 U.S.C. 154(b) by 0 days.

(21) Appl. No.: 09/643,307

(22) Filed: Aug. 21, 2000

(51) Int. Cl.[7] ..... B41F 35/00

(52) U.S. Cl. ..... 101/423; 101/425; 15/93.4; 15/256.5

(58) Field of Search ..... 101/423, 424, 101/425; 15/93.1, 93.4, 236.01, 256.5, 256.53

(56) References Cited

U.S. PATENT DOCUMENTS 3,031,703 A * 5/1962 Linke ..... 15/102
3,992,791 A * 11/1976 Dean ..... 37/116
4,202,437 A * 5/1980 Gordon ..... 198/497
6,092,878 A * 7/2000 Arbucci ..... 15/93.1

FOREIGN PATENT DOCUMENTS

JP 61-175040 * 8/1986 ..... 101/425
JP 2-80250 * 3/1990 ..... 101/425

* cited by examiner

*Primary Examiner*—Ren Yan
(74) *Attorney, Agent, or Firm*—Wood, Herron & Evans, L.L.P.

(57) ABSTRACT

A scraping machine for scraping glue off of a screen printing frame that includes a base adapted to support a screen printing frame. A first actuator is mounted on the base and has a carriage movable by the first actuator. A scraper vibrator is pivotally mounted to the carriage and imparts a vibration to the scraper blade. A second actuator is used to pivot the scraping blade into and out of contact with a surface of the screen printing frame to be scraped. When the scraping blade is in contact with the screen printing frame, the first actuator is used to move the scraping blade across a surface of the screen printing frame.

23 Claims, 2 Drawing Sheets

SCREEN PRINTING FRAME SCRAPER

FIELD OF THE INVENTION

This invention relates to printing and more particularly, to a screen printing frame cleaning apparatus and method.

BACKGROUND OF THE INVENTION

In some printing processes, for example, a silk screen printing process, a silk screen fabric is adhered or glued to a screen printing frame, and the silk screen fabric is used to produce an image on a substrate, for example, a CD disk label. As the images are changed, the current silk screen fabric is torn off or removed from the silk screen printing frame; and a new silk screen fabric with a new image is then adhered or glued to the frame. Normally, the same type of glue or adhesive is used, and it is not necessary that the old adhesive or glue be completely removed from the screen printing frame prior to the new silk screen fabric being glued thereon. Further, normally it is not a problem if the new silk screen fabric is glued over some older residual glue on the screen printing frame.

However, occasionally, the type of adhesive or glue being used is changed, for example, a solvent based glue is replaced with a water-based or latex glue. Further, in this example, the new water-based glue does not adhere or stick to the old solvent based glue. Therefore, before the new glue can be used, the surfaces on the screen printing frame on which the new glue is to be applied must be cleaned of the old glue. In some production environments, there are tens of thousands of screen printing frames used in production. Therefore, the task of cleaning the old glue from so many screens in daunting. Commercially available machinery is often used to clean screen printing frames. However such cleaning machinery is very expensive and is normally designed to clean large wooden screen printing frames. Thus, such machinery is less effective at cleaning smaller metal frames. Further, such machinery has additional disadvantages of using harsh chemicals in the cleaning process; and often, such chemicals require special handling and disposal.

To facilitate the adherence of a silk screen fabric, the surfaces of the screen printing frame to which the silk screen fabric is applied are often sandblasted to provide a textured surface. Further, to provide a more durable textured surface, the sandblasted surfaces are nickel plated. The old glue can physically be removed by mechanical methods such as sanding, brushing or grinding; however, all of those processes often damage or destroy the nickel plated finish. Further, the metal screen printing frames can be cleaned by using a manual scraper; however, such manual scraping is often performed inconsistently which results in damage to the nickel plated finish of the screen printing frame. In addition, the prospect of cleaning a large number of silk screen printing frames by a manual process is unacceptable.

Consequently, there is a need for a screen printing frame cleaning device and process that does not have the limitations and disadvantages of known devices and processes.

SUMMARY OF THE INVENTION

The present invention provides a simple, reliable, inexpensive, easy to use scrapping machine and a process for cleaning glue or adhesive from surfaces of screen printing frames. In addition, the scraping machine of the present invention cleans the frames relatively quickly with a minimum of labor. The scraping machine of the present invention is especially useful when a very large number of metal screen printing frames must be cleaned.

According to the principles of the present invention and in accordance with the preferred embodiments, the invention provides a scraping machine for scraping material off of a screen printing frame that includes a base adapted to support a screen printing frame. A first actuator is mounted on the base and has a carriage movable by the first actuator. A scraper blade is mounted on the carriage and contacts the screen printing frame. The scraper blade is moved across the screen printing frame by the first actuator, thereby scraping the material off of the screen printing frame. The scraping machine of the present invention is the only apparatus known to Applicant that can reliably clean thousands of metal frames without damaging the surfaces of the frames.

In one aspect of the invention, the scraping machine includes a scraper vibrator for imparting a vibration to the scraper blade. In a further aspect of the invention, the scraper vibrator is pivotally mounted to the carriage, and an actuator is used to pivot the scraping blade into and out of contact with a surface of the screen printing frame to be scraped.

In another embodiment of the invention, a method is provided of scraping material from a screen printing frame that includes the provision of a scraper blade. Next, a vibratory motion is imparted to the scraper blade with a scraper vibrator; and the vibrating scraper blade is then moved with a first actuator across a surface of the screen printing frame to scrape the material therefrom.

These and other objects and advantages of the present invention will become more readily apparent during the following detailed description taken in conjunction with the drawings herein.

DETAILED DESCRIPTION OF THE INVENTION

Figure 1:
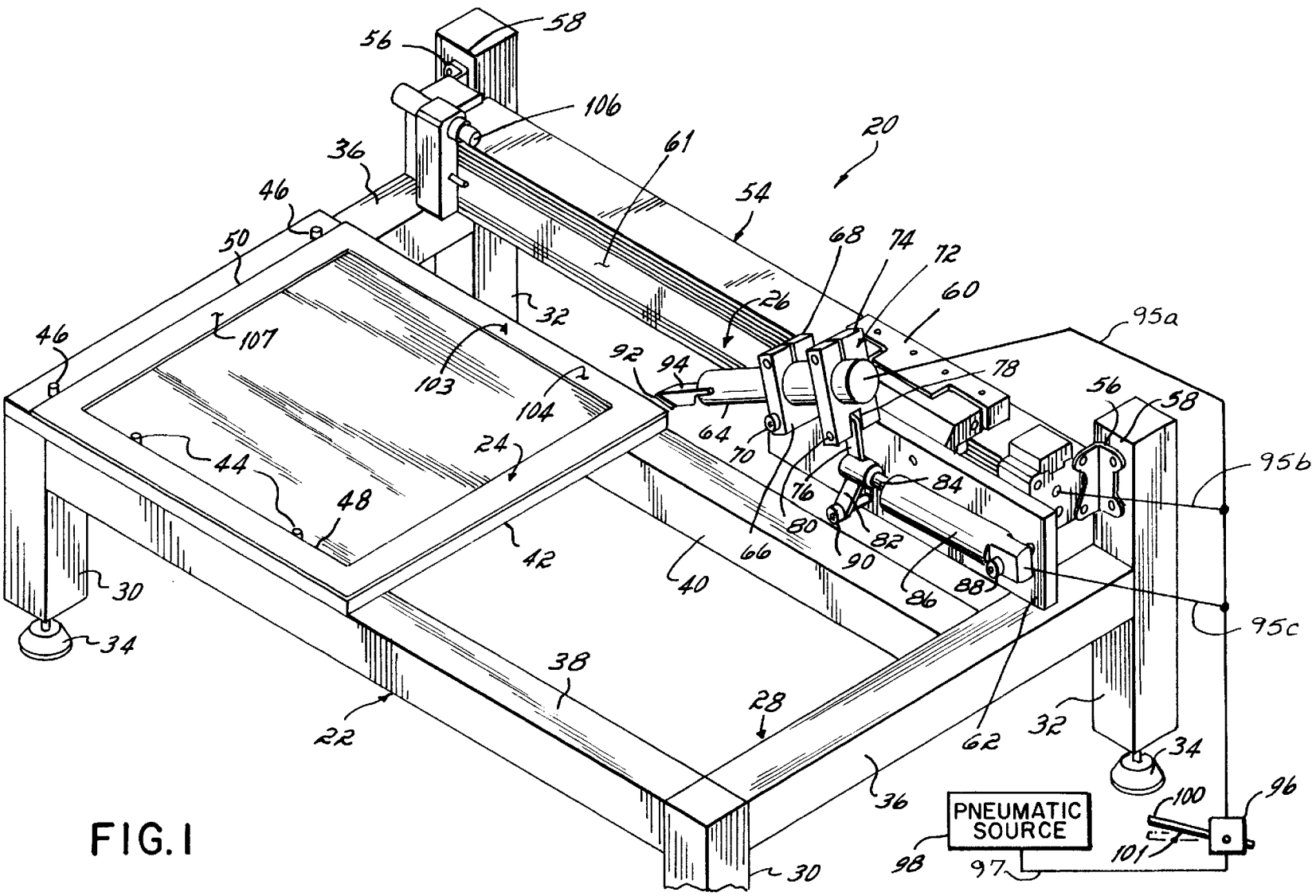
FIG. 1 is a perspective view of a screen printing frame scraper in accordance with the principles of the present invention.

Referring to FIG. 1, a scraping machine 20 is comprised of a base 22 that supports the screen printing frame 24 and a scraping device 26. The base 22 is comprised of a generally rectangular frame 28 supported by two generally vertical front legs 30 and two generally vertical rear legs 32 connected to the frame at its corners. The legs 30, 32 are supported on adjustable feet 34 that are threaded into the lower ends of the legs 30 in a known manner. The support frame 28 includes cross rails 36 extending between the front and rear legs 30, 32, respectively. The support frame 28 also has a side rail 38 extending between the front legs 30 and an intermediate support rail 40 extending between the cross rails 36. A surface plate 42 is mounted on top of the front and intermediate support rails 38, 40, respectively, by screws or other fasteners. Inside locating pins 44 and outside locating pins 46 are attached to the surface plate 42 and provide locating surfaces against which an inside edge 48 and an outside edge 50 are placed in positioning the screen printing frame 24 on the surface plate 42. The inside locating pins 44 form a locus of points defining a first line, and the outside locating pins 46 form a locus of points defining a second line that is substantially perpendicular to the first line.

The legs 30, 32, and rails 36, 38, 40 are normally of the same cross-sectional area and are made from any material suitable for such structural members, for example, extruded aluminum beams and associated fasteners commercially available from Item Products, Inc. of Livonia, Mich. The base 22 is assembled by tapping a center through-hole in the ends of the rails 36, 38, drilling clearance holes through the sides of the vertical legs 30, 32 at the appropriate locations, and using threaded fasteners to connect the rails and legs together. The support rail 40 is assembled to the crossrails 36 in a similar manner. The surface plate is made from any stock material that provides sufficient strength, for example, a 0.500 inch aluminum plate, and the pins 44, 46 are of any suitable material, for example, aluminum, wood, etc.

The scraping device 26 includes a first actuator 54 mounted by brackets 56 to the upper ends 58 of the rear legs 32. The first actuator 54 can be any type of linear actuator, for example, a mechanically coupled, double acting, rodless cylinder, type DGPL commercially available from Festo Corporation of Hauppage, N.Y. The rodless cylinder 54 has a carriage 60 that is supported by a linear bearing guide 61 that is commercially available with the cylinder 54. A mounting plate 62 is rigidly connected to the carriage 60 by fasteners, welding, adhesives or other means.

A scraper vibrator 64 is secured within a pivot block 66 by a clamp 68. The pivot block 66 is pivotally mounted to the mounting plate 62 by a shoulder bolt 70. Thus, the scraper vibrator 64 pivots freely with respect to a center line of the shoulder bolt 70. A clevis block 72 is secured to the end of the scraper vibrator 64 by a clamp 74. One end of a first lever 76 is pivotally mounted within the clevis 78 of the block 72 by means of a pin 80 extending therethrough. The opposite end of the first lever 76 and one end of a second lever 82 are pivotally mounted to the end of an actuator rod or piston 84 extending from a second actuator 86. The first and second levers 76, 82 form a toggle operated by the rod 84. The second actuator 86 is pivotally mounted to the mounting plate 62 by a shoulder bolt 88, and the opposite end of the second lever 82 is mounted to the mounting plate 62 by a shoulder bolt 90. A scraper tool or blade 92 is mounted to a blade adapter 94 that, in turn, is mounted to the end of the scraper vibrator 64.

The scraper vibrator 64 may be any type of electric or pneumatic vibrating scraper, for example, a pneumatic scraper commercially available from Florida Pneumatic of Jupiter, Fla. The blade 92 can be any type of scraping blade, however, it has been found that a carbide planer knife normally used for woodworking provides an excellent scraping action and long life. The carbide blade 92 is ground to have an angle of 15°–20° for the best scraping action. Further, the blade is attached to the blade adapter 94 by screws or other fasteners to permit easy blade replacement.

To provide a low friction pivoting action, the shoulder bolts 70, 90 extend through "IGLIDE" bearing sleeves. In addition, "IGLIDE" flange bearings are utilized at the other pivoting connections at the ends of the first and second levers 76, 82. The "IGLIDE" sleeves and flanges are commercially available from Igus Inc. of East Providence, R.I. The actuator 86 may be any type of pneumatic or hydraulic cylinder, for example, a "SPRINTER 2000", ISO 6432, DSNU/DSNUL double acting cylinder commercially available from Festo Corporation of Hauppage, N.Y. The scraper vibrator 64 and cylinders 54, 86 are fluidly connected via commonly connected fluid lines 95*a*, 95*b*, 95*c* to a foot operated valve 96 that, in turn, is connected via fluid line 97 to a source of pressurized pneumatic fluid, for example, pressurized shop air, 98. The foot valve 96 is a treadle valve in which the valve is opened by depressing the toe end 100 of the pedal 101 to a downward position as shown in phantom. The valve 96 is closed by releasing the toe end 100 of the pedal 101 and allowing it to return, via spring bias or otherwise, to its initial raised position as shown in FIG. 1.

Figure 2A:
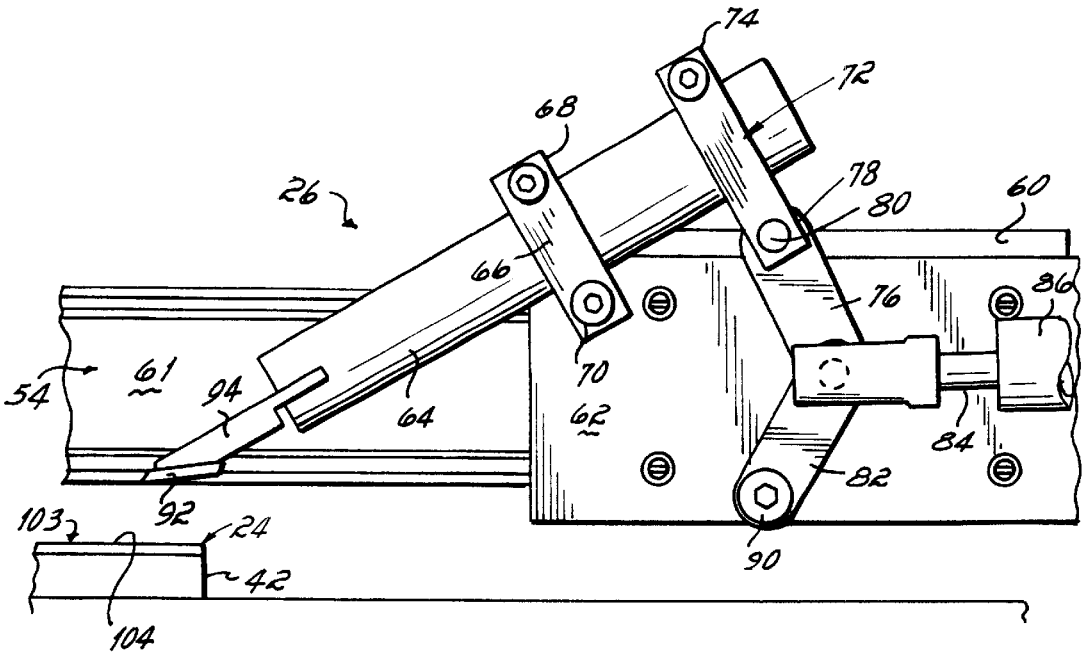
FIG. 2A is a partial side elevation illustrating the screen printing frame scraper of FIG. 1 in its raised position.

In use, the cylinder 86 and scraper vibrator 64 start in their respective retracted and raised positions as shown in FIGS. 1 and 2A. A screen printing frame 24 is first passed through a cleaning bath to soften the old glue. Next, the frame 24 is located against the pins 44, 46 on the surface plate 42, so that a first side 103 is positioned under the blade 92. After the frame 24 is properly positioned, the operator depresses the toe end 100 of the valve 96, thereby opening the valve 96 and providing pressurized air from the pneumatic source 98 to the scraper vibrator 64 and cylinders 54, 86. The mass of the load on the actuator 54 is greater than the mass of the load on the actuator 86, and the mass of the load on the actuator 86 is greater than the mass of the load on the scraper vibrator 64. Therefore, the compressibility of the pressurized air results in the scraper vibrator 64 and actuators 54, 86 beginning their operations at different times. For example, the scraper vibrator 64 is moving the least load or mass; and therefore, upon the valve 96 being actuated, the scraper vibrator 64 begins vibrating the scraper blade 92 prior to the cylinders 54, 86 being fully operative.

Figure 2B:
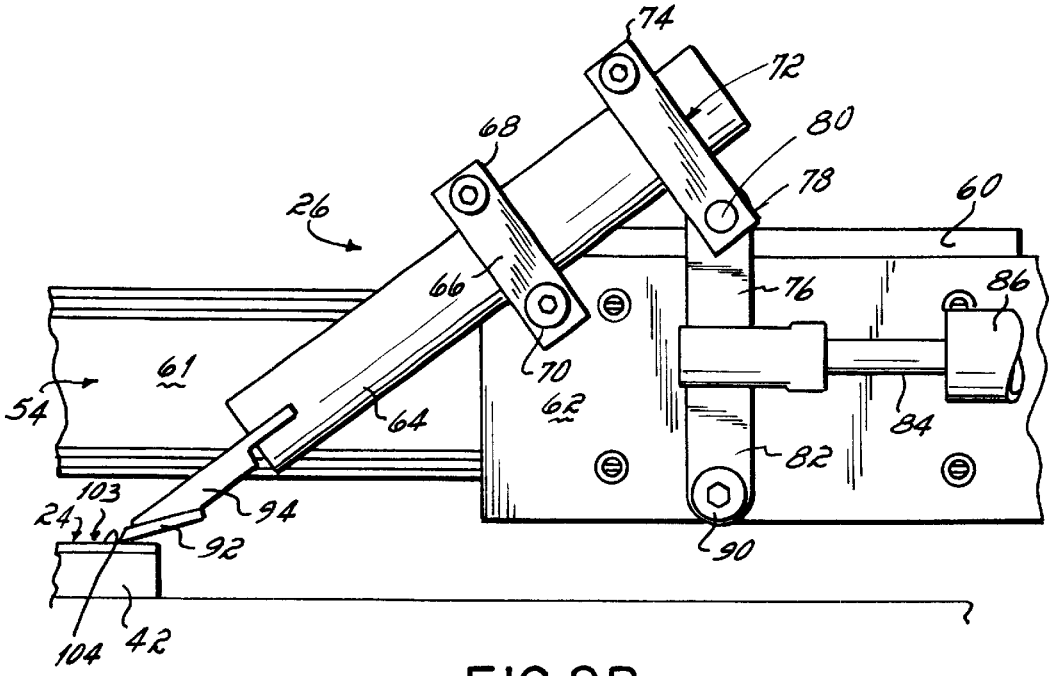
FIG. 2B is a partial side elevation illustrating the screen printing frame scraper of FIG. 1 in its lowered position.

The cylinder 86 is moving a lesser mass or load than the cylinder 54; and hence, the cylinder 86 begins its operation prior to the cylinder 54 being fully operative. As the cylinder 86 extends its rod 84, the levers 76, 82 pivot. The upper end of the lever 76 moves the clevis 78 in a vertically upward direction, thereby pivoting the scraper vibrator 64 with respect to the shoulder bolt 70 in a generally counterclockwise direction. The pivoting motion of the scraper vibrator 64 lowers the scraper blade 92 onto the upper surface 104 of the side 103 of the frame 24 as shown in FIG. 2B. Further, the scraper blade 92 not only contacts the upper surface 104 but is pressed down on the surface 104 by the action of the levers 76, 82 forming a toggle and moving to a position in which their longitudinal centerlines are substantially aligned or parallel. Further, with the levers 76, 82 in that aligned position, the levers 76, 82 resist any forces tending to raise the scraper blade 92 off of the surface 104 and thus, firmly hold the scraper blade 92 at the desired scrape angle on the surface 104.

Having the greatest mass or load to move, the cylinder 54 is the last device to initiate its operation. Upon sufficient pneumatic pressure building up within the actuator 54, the carriage 60, mounting plate 62, and scraper vibrator 64 begin to move on the linear guide 61 along a scraping path generally right to left as viewed in FIG. 1. With the scraper tool 92 vibrating and in contact with the upper surface 104 of the frame 24, any material such as residual glue remaining on the surface 104 of the frame 24 is scraped off and removed from the surface 104 by the vibrating tool 92. The linear motion of the vibrating tool 92 continues along the scraping path in the right to left direction as viewed in FIG.

1 until the carriage 60 strikes the stop 106. The stop 106 is adjusted such that it stops the carriage 60 upon the scraper blade 92 extending over the outer edge 50 of the frame 24.

The above-described scraping operation takes only a couple of seconds. It should be noted that to achieve the desired scraping action, various parameters must be tuned or adjusted and a scraping cycle executed to observe the results. One parameter that may require adjustment is the oscillation frequency of the scraper vibrator 64 which changes as a function of the flow rate of the pressurized air through the scraper vibrator. Another parameter affecting the quality of the scraping action is the angle of attack of the scraper blade 92 with respect to the surface 104 which normally is approximately 35°. The angle formed by the edge of the scraper blade 92 which is normally approximately 18° can also be adjusted. The downward force or pressure that the scraper blade 92 applies against the surface 104 and the rate at which the cylinder 54 moves the scraper blade 92 across the surface 104 are other parameters that affect the quality of the scraping action and are adjustable.

Upon the carriage 60 striking the stop 106, the operator then releases the toe end 100 of the pedal 101; and the toe end 100 of the pedal 101 is returned to its initial raised position by a spring (not shown) in a known manner. When the pedal is released, the valve 96 terminates the flow of pressurized air to the scraper vibrator 64 and reverses the flow of pressurized air through the cylinders 54, 86. Thus the scraper vibrator 64 stops and the cylinder 86 reverses its operation, retracting the cylinder rod 84. As the cylinder rod 84 retracts, the scraper vibrator 64 pivots in a generally clockwise direction with respect to the shoulder bolt 70, thereby lifting the scraper tool 92 off the surface 104 to the position illustrated in FIGS. 1 and 2A. Thereafter, the cylinder 54 begins to move the carriage 60, mounting plate 62 and scraper vibrator 64 linearly in a generally left to right direction as viewed in FIG. 1 until the carriage 60 bottoms out at the opposite or right end of the cylinder 54 as illustrated in FIG. 1.

The operator then lifts the screen printing frame 24 off of the pins 44, 46, rotates the frame 90° and locates another side, for example, side 107 beneath the scraper blade 92. The toe end 100 of the foot pedal 101 is again depressed to execute the process described with respect to the side 103 of the frame 24. The process is again repeated until all four sides of the screen printing frame 24 have been cleaned.

The above invention provides a reliable, inexpensive, easy to use scrapping machine for cleaning glue or adhesive from surfaces of screen printing frames. Further, the scraping machine of the present invention is the only apparatus known to Applicant that can reliably clean thousands of frames without damaging the frames. In addition, the scraping machine cleans the frames relatively quickly with a minimum of labor.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described example, the actuator 86 is used to pivot the scraper blade 92 into and out of contact with the surface 104 of the screen printing frame 24. As will be appreciated, the levers 76, 82 can be moved manually. Further, the levers 76, 82 can be moved past or toggled over their aligned positions to lock the levers 76, 82 and hold the scraping blade 92 against the surface 104. A single action treadle valve 96 was described for operating the scraping machine. As will be appreciated, a double action valve, multiple valves connected to respective actuators or other actuator arrangements may be used. In addition, while various commercially available parts have been identified, as will be appreciated other comparable commercial parts may be used.

Therefore, the invention in its broadest aspects is not limited to the specific details shown and described. Consequently, departures may be made from the details described herein without departing from the spirit and scope of the claims which follow.

What is claimed is:

1. A scraping machine for scraping material off of a screen printing frame comprising:

a base adapted to support a screen printing frame;

a first actuator mounted on the base and having a carriage movable with respect to the base by the first actuator; and a scraper blade mounted on the carriage and contacting the screen printing frame, the scraper blade being movable across the screen printing frame by the first actuator, thereby scraping the material off of the screen printing frame.

2. The scraping machine of claim 1 wherein the first actuator is a linear actuator.

3. The scraping machine of claim 2 wherein the first actuator is a fluid operated cylinder.

4. The scraping machine of claim 1 wherein the base further comprises at least two rails for supporting the screen printing frame being scraped by the scraper blade.

5. The scraping machine of claim 4 further comprising a surface plate mounted on the two rails and adapted to receive the screen printing frame.

6. The scraping machine of claim 1 further comprising a scraper vibrator mounted to the carriage and supporting the scraper blade, the scraper vibrator being operable to impart a vibrating motion to the scraper blade.

7. The scraping machine of claim 6 wherein the scraper vibrator is pivotally mounted to the carriage.

8. The scraping machine of claim 7 further comprising a second actuator mounted to the carriage the second actuator having a movable element in mechanical communication with the scraper vibrator, the second actuator pivoting the scraper vibrator, thereby moving the scraper blade into and out of contact with the screen printing frame.

9. The scraping machine of claim 8 wherein the second actuator is a fluid operated cylinder.

10. The scraping machine of claim 9 wherein the first and second actuators and the scraper vibrator are pneumatically operated devices.

11. The scraping machine of claim 1 wherein the screen printing frame is multilateral and the scraping machine further comprises a plurality of pins fixed with respect to the base, the plurality of pins contacting at least two adjacent sides of the screen printing frame upon the screen printing frame being placed on the base.

12. The scraping machine of claim 11 wherein the plurality of pins comprises first pins contacting an inner edge of one side of the frame and second pins contacting an outer edge of a second side of the frame.

13. The scraping machine of claim 12 wherein the first pins form a locus of points defining a first line substantially perpendicular to a path of the scraper blade and the second pins form a locus of points defining a second line substantially perpendicular to the first line.

14. The scraping machine of claim 13 further comprising a surface plate mounted on the base, the first and second pins being mounted in the surface plate and the surface plate adapted to receive the screen printing frame.

15. The scraping machine of claim 14 wherein the first pins are adapted to contact an outer edge of a first side of the screen printing frame and the second pins are adapted to contact an inner edge of a second side of the screen printing frame.

16. A scraping machine for scraping material off of a screen printing frame comprising:

a base adapted to support a screen printing frame;

a first actuator mounted on the base and having a carriage movable with respect to the base by the first actuator;

a scraper vibrator mounted to the carriage;

a scraper blade mounted in the scraper vibrator, the scraper vibrator providing a vibratory motion to the scraper blade; and a second actuator mounted on the carriage and operatively connected to the scraper vibrator, the scraper vibrator being movable by the second actuator to move the scraper blade into and out of contact with the screen printing frame, the scraper blade being movable across the screen printing frame by the first actuator, thereby scraping the material off of the screen printing frame.

17. The scraping machine of claim 16 wherein the first actuator moves the carriage, scraper vibrator and scraper blade linearly along a scraping path with respect to the screen printing frame.

18. The scraping machine of claim 17 wherein the first actuator is a rodless cylinder.

19. The scraping machine of claim 16 wherein the carriage is mounted on a linear guide.

20. The scraping machine of claim 16 wherein the scraper vibrator is pivotally mounted to the carriage and the second actuator pivots the scraper vibrator and scraper blade into and out of contact with the screen printing frame.

21. The scraping machine of claim 16 further comprising:

a source of pressurized air;

a valve fluidly connected between the source of pressurized air and the first and second actuators and the scraper vibrator.

22. The scraping machine of claim 21 wherein a mass of a load on the first actuator is greater than a mass of a load on the second actuator, such that upon opening the valve and simultaneously applying the pressurized air to the first and second actuators, the second actuator operates first to pivot the scraper vibrator and scraper blade into contact with the screen printing frame prior to the first actuator operating to move the scraper vibrator and scraper blade across the screen printing frame.

23. The scraping machine of claim 22 wherein a mass of a load on the second actuator is greater than a mass of a load on the scraper vibrator, such that upon opening the valve and simultaneously applying the pressurized air to the second actuator and the scraper vibrator, the scraper vibrator begins vibrating the scraper blade prior to the second actuator operating to pivot the scraper vibrator and scraper blade into contact with the screen printing frame.

* * * * *

UNITED STATES PATENT AND TRADEMARK OFFICE

CERTIFICATE OF CORRECTION

PATENT NO. : 6,374,736 B1
DATED : April 23, 2002
INVENTOR(S) : Cresgy et al.

It is certified that error appears in the above-identified patent and that said Letters Patent is hereby corrected as shown below:

Column 6,
Line 50, reads “to the carriage the” and should read -- to the carriage, the --

Signed and Sealed this

Ninth Day of July, 2002

*Attest:*

*Attesting Officer*

JAMES E. ROGAN
*Director of the United States Patent and Trademark Office*